US006449799B1

(12) United States Patent
Keller

(10) Patent No.: US 6,449,799 B1
(45) Date of Patent: Sep. 17, 2002

(54) HYDRO-THERMAL DUAL INJECTED VACUUM SYSTEM

(76) Inventor: Kris D. Keller, 826 S. College Ave., College Place, WA (US) 99324

( * ) Notice: Subject to any disclaimer, the term of this patent is extended or adjusted under 35 U.S.C. 154(b) by 0 days.

(21) Appl. No.: 09/556,242

(22) Filed: Apr. 24, 2000

Related U.S. Application Data

(63) Continuation of application No. 09/042,894, filed on Mar. 16, 1998, now Pat. No. 6,052,861.

(51) Int. Cl.[7] ..... A47L 11/30
(52) U.S. Cl. ..... 15/322; 15/345
(58) Field of Search ..... 15/320, 321, 322, 15/345, 346

(56) References Cited

U.S. PATENT DOCUMENTS

| | | | | |
|---|---|---|---|---|
| 1,211,948 A | | 1/1917 | Koster et al. | 15/320 |
| 3,273,193 A | * | 9/1966 | Soderholm et al. | 15/320 |
| 3,484,890 A | | 12/1969 | Case | 15/346 |
| 3,747,155 A | * | 7/1973 | Koellisch | 15/322 |
| 3,774,262 A | * | 11/1973 | Anthony et al. | 15/322 |
| 3,940,826 A | * | 3/1976 | Phillips et al. | 15/345 X |
| 3,964,925 A | * | 6/1976 | Burgoon | 15/322 X |
| 4,333,205 A | * | 6/1982 | Woodward et al. | 15/345 |
| 4,595,420 A | * | 6/1986 | Williams et al. | 15/320 X |
| 4,884,315 A | | 12/1989 | Ehnert | 15/346 |
| 5,208,940 A | * | 5/1993 | London et al. | 15/345 |
| 5,289,610 A | * | 3/1994 | Monson | 15/346 X |
| 5,457,848 A | | 10/1995 | Miwa | 15/346 |
| 5,553,347 A | * | 9/1996 | Inoue et al. | 15/346 X |
| 6,173,473 B1 | * | 1/2001 | Miwa | 15/345 |

* cited by examiner

*Primary Examiner*—Chris K. Moore
(74) *Attorney, Agent, or Firm*—Wells St. John P.S.

(57) ABSTRACT

A vacuum system is described in which a hollow vacuum housing is provided with an intake plenum leading from an open bottom housing end of the housing to a vacuum line connector. A vacuum pump is attached to the vacuum line to produce suction through the intake plenum. A hot air housing is situated within the hollow vacuum housing and includes a hot air discharge plenum. The hot air discharge plenum is defined by a wall within the intake plenum, leading from an open bottom end that is substantially circumscribed by the intake plenum. A hot air blower on the hot air housing moves hot air downwardly. The hot air moves against the surface being cleaned or dried and is subsequently drawn back upwardly through the intake plenum. At least one and preferably two compressed injection air discharge lines are positioned within the hot air housing. Each line includes compressed injection air discharge openings oriented to direct air downwardly and angularly toward the intake plenum, carrying the hot air in the same direction. A fluid discharge line is positioned within the intake plenum adjacent the bottom end and includes fluid discharge openings oriented to direct pumped fluid downwardly and angularly toward the bottom end of the hot air discharge plenum to impinge upon the surface being cleaned and to be subsequently drawn into the intake plenum.

84 Claims, 6 Drawing Sheets

HYDRO-THERMAL DUAL INJECTED VACUUM SYSTEM

CROSS-REFERENCES TO RELATED CASES

This is a continuation of U.S. patent application Ser. No. 09/042,894, filed Mar. 16, 1998, now U.S. Pat. No. 6,052,861.

TECHNICAL FIELD

The present invention relates to cleaning systems, and more particularly to a cleaning and drying head in a combined pressure and vacuum cleaning system.

BACKGROUND OF THE INVENTION

The typical vacuum cleaner makes use of vacuum pressure to draw air and debris adjacent to the vacuum cleaner head into a collection device. Many different forms of vacuum cleaner heads have been developed in the past to aid the debris collection effort. "Beater" bars are a typical example of such auxiliary devices. The "beater" bar is used to agitate an area of the surface to be cleaned with the hope of loosening debris that would not otherwise be loosened by the air being drawn into the vacuum cleaner. The difficulty with "beater" bars is that they require power for operation, they cause wear on the surface being cleaned, and they eventually wear out and require replacement. Still, the general objective of creating agitation of the surface being cleaned is sound, since vacuum pressure alone is often not effective in removing all debris.

Commercial cleaners often make use of liquid cleaning solutions that are pressure sprayed on an area immediately ahead of a high pressure vacuum head. The cleaner solution will loosen much of the soil or other materials that has become attached to the surface to be cleaned. The vacuum head is then expected to draw up all the cleaner solution and loosened material, leaving the surface both dry and clean. Unfortunately, this is very seldom the case, since a vacuum system working alone is typically not powerful enough to lift all the solution up from the surface. Much of the solution (and dirt) is left behind.

Various attempts have been made in the past to further improve vacuum cleaning systems. For example, in U.S. Pat. No. 3,663,984 granted to Anthony et al. May 23, 1972 suggests the use of pressurized air for creating agitation and assisting drying. In fact two sources of pressurized air are used on the Anthony cleaning head. A source of heated, pressurized air is directed from a discharge above and to one side of the vacuum intake opening. The second source of pressurized air is spaced to an opposite side of the intake opening, between two sets of liquid spray nozzles. The second source of pressurized air is said to produce agitation between the two fluid discharges while the first source is used primarily for drying the cleaned surface. All the nozzles and air pressure housings are connected to a specially designed portable two-tank pumping and vacuum arrangement that are advisedly connected to different electrical circuits to avoid circuit overloading.

While the Anthony system is a likely improvement over "beater bar" systems, a need remains for a cleaner head and system that does not require specialized pumping systems, and that will provide improved cleaning and drying action for various surfaces to be cleaned and dried.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

Figure 1:
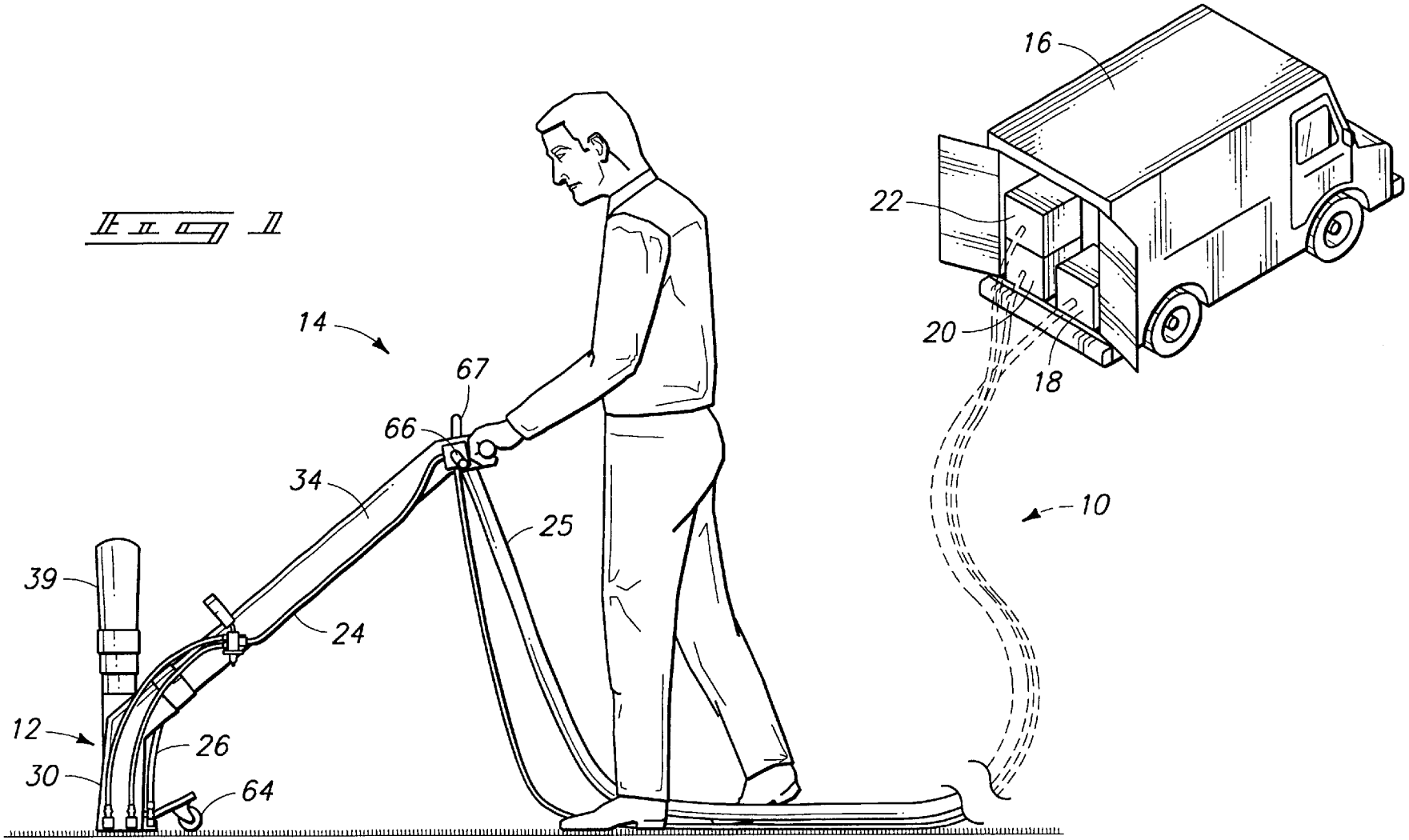
FIG. 1 is a diagrammatic view illustrating a preferred form of the present invention in operation.
Figure 3:
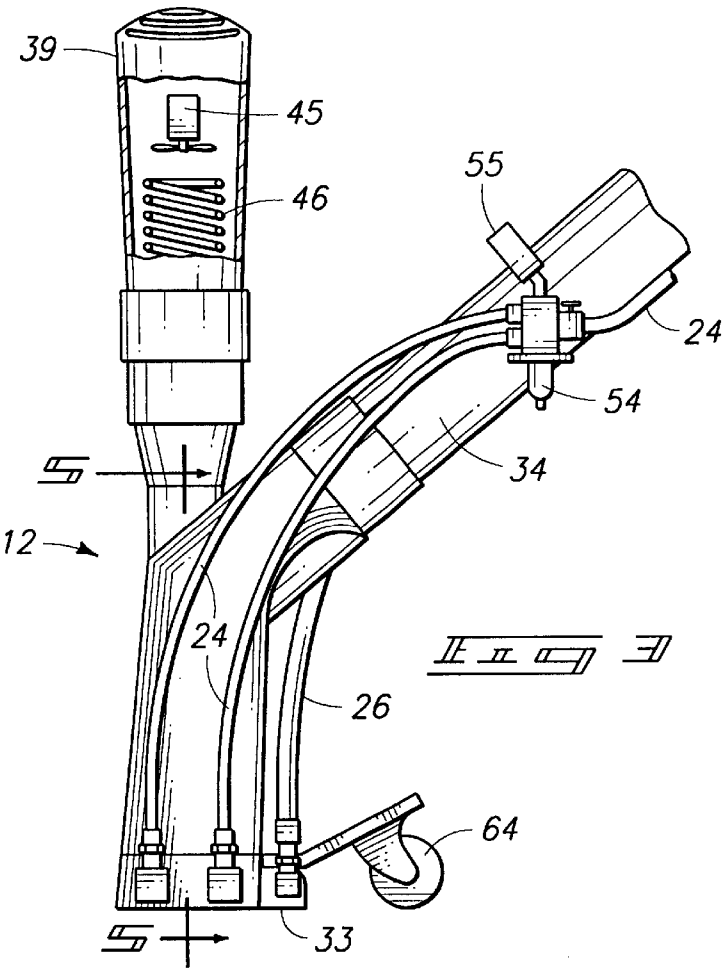
FIG. 3 is a fragmented side elevation as viewed from the right in FIG. 2.
Figure 2:
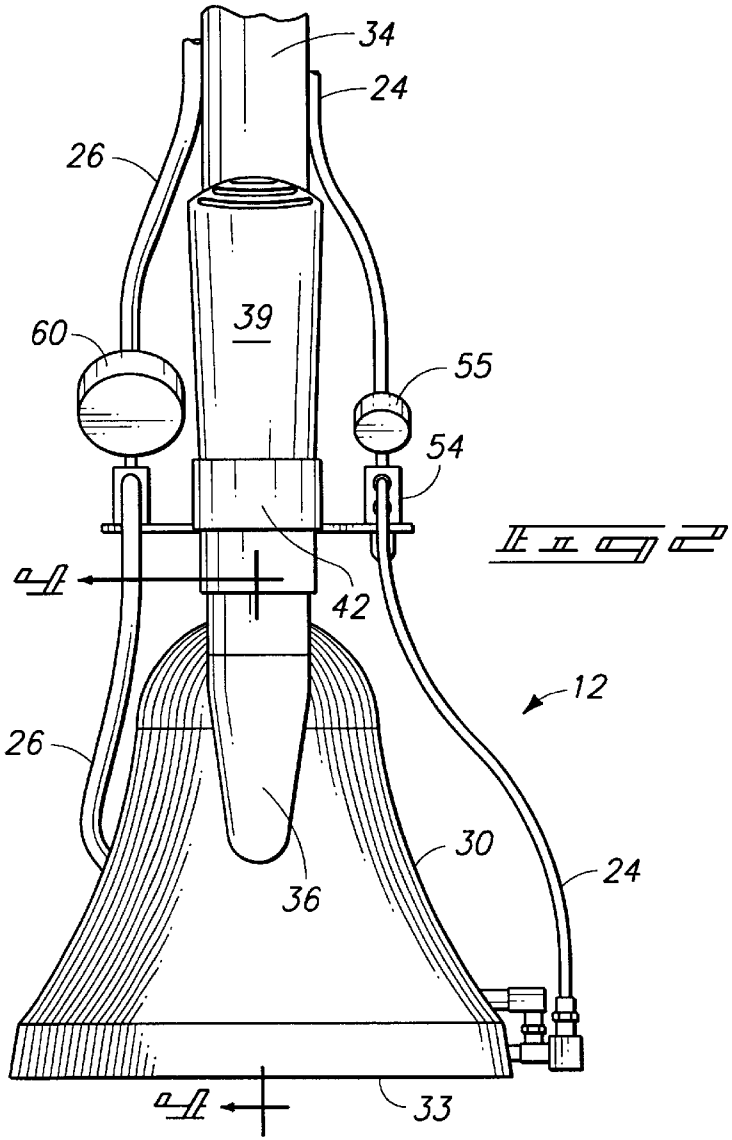
FIG. 2 is a fragmented front end elevational view of a preferred cleaning head.

This disclosure of the invention is submitted in furtherance of the constitutional purposes of the U.S. Patent Laws "to promote the progress of science and useful arts" (Article 1, Section 8).

The present invention is generally shown by the reference numeral 10 in the accompanying drawings. The intent of the present invention is to provide a cleaning and drying system by which floor surfaces can be efficiently and well cleaned, particularly carpeted floors. The invention is of particular significance in cleaning carpets, drying carpets, and most preferably in both cleaning and drying carpets in a single operation. The problem of prior carpet cleaning systems in leaving a wet carpet is of particular concern.

In FIG. 1, a preferred form of the invention includes a cleaning head 12 in combination in a vacuum cleaning system 14. Here, the cleaning head 12 is shown connected to external pressure sources. In the illustrated example, a van or other appropriate carrier vehicle 16 is provided to house and transport a vacuum pump 18, an air pressure pump 20 and a fluid pump 22 for connection to the head 12. The vacuum pump serves as a vacuum source or supply. The air pressure pump or compressor serves as a pressurized gas source or supply. The fluid pump serves as a cleaning fluid source or supply. These may be conventional "off-the-shelf" commercial or industrial grade machines with capacities selected according to the work to be accomplished.

In the example illustrated, the components including vacuum pump 18, air pressure pump 20 and fluid pump 22 are selected for carpet cleaning purposes. To this end, the vacuum pump 18 is preferably a commercially available impeller driven vacuum, capable of developing an unloaded static lift of between 80 and 140 inches (water) at a minimum of 90 cubic feet per minute (cfm) in a conventional 2 inch vacuum hose line 25.

The air pressure pump 20 may be a conventional compressor with attached collector tanks capable of delivering air under pressure through a high pressure air hose 24 at between 40 and approximately 100 psi, adjustable according to the nature of the surface to be cleaned. It is preferred that the air pressure pump also be capable of delivering compressed injection air at the above pressure range with a flow rate up to approximately 12 cfm.

The fluid pump 22 is preferred for carpet and other floor cleaning operations to be a high pressure washer, capable of delivering a cleaning fluid or water through a fluid pressure hose 26 at operating pressures of up to 1500 psi (preferably about 100 psi to 300 psi for carpet cleaning) at a selectable rate of between 0.5 and 2 gallons per minute (gpm). It is preferred that the fluid also be heated, to a temperature of approximately 200 degrees F.

The rate of fluid application (up to approximately 2 gpm) is relatively high compared to typical conventional carpet cleaners. Such high fluid application rates are allowable with the present invention and are preferred for maximum cleaning efficiency. This is due to significant drying capability provided through directionally oriented application of hot air under pressure toward closely spaced vacuum components described above, and by further structure described below.

It is pointed out that the above components may be provided in combination with the cleaning head 12, or that the cleaning head may be manufactured and distributed separately, for use with various combinations of vacuums, air pressure pumps, and fluid pumps. Details of the cleaning head 12 will now be discussed.

A preferred form of the present cleaning head 12 is shown in detail by FIGS. 2–9 of the drawings. Cleaning head 12 has a main housing 30 which is preferably formed of a rigid material such as fabricated or cast aluminum, although other materials may be suitable for constructing the unit having features shown herein or equivalent thereto.

Figure 6:
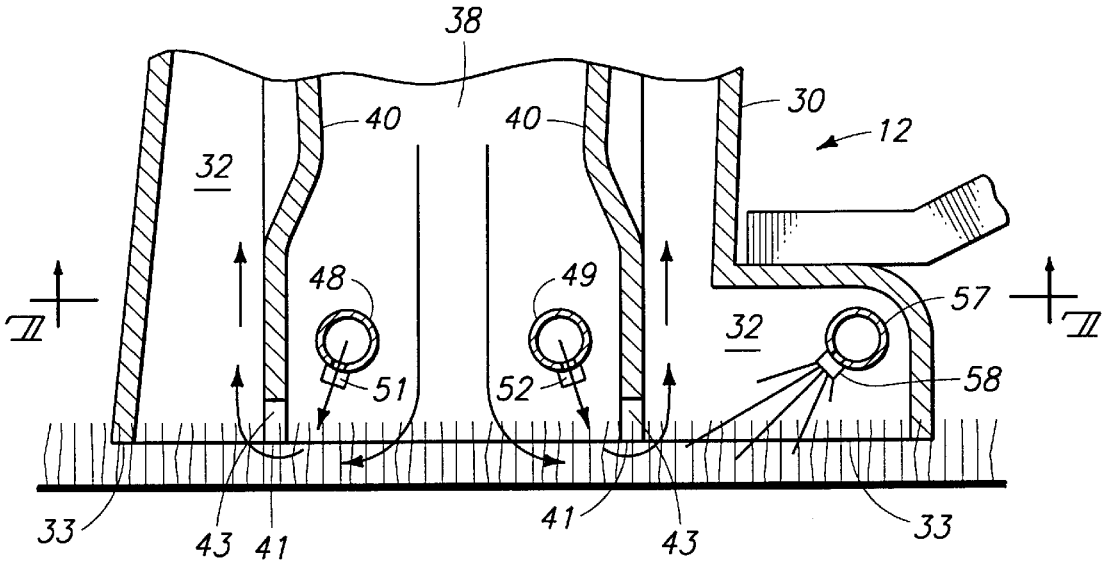
FIG. 6 is an enlarged operational view illustrating various fluid flow paths with directional arrows.
Figure 7:
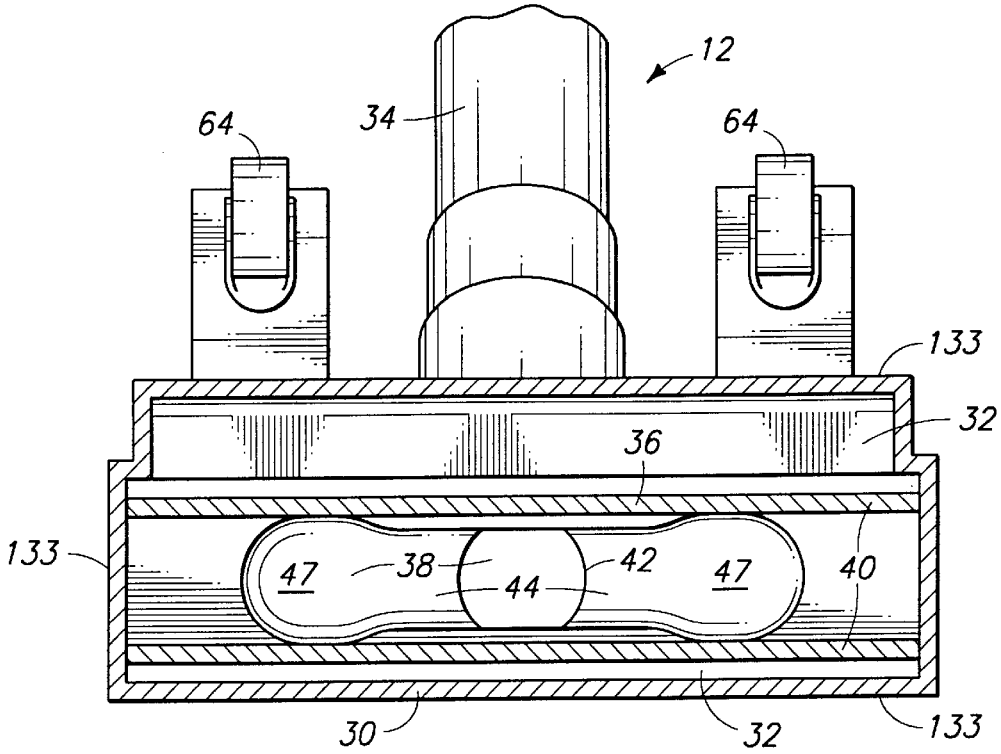
FIG. 7 is a sectional view taken substantially along line 7—7 in FIG. 6.
Figure 8B:
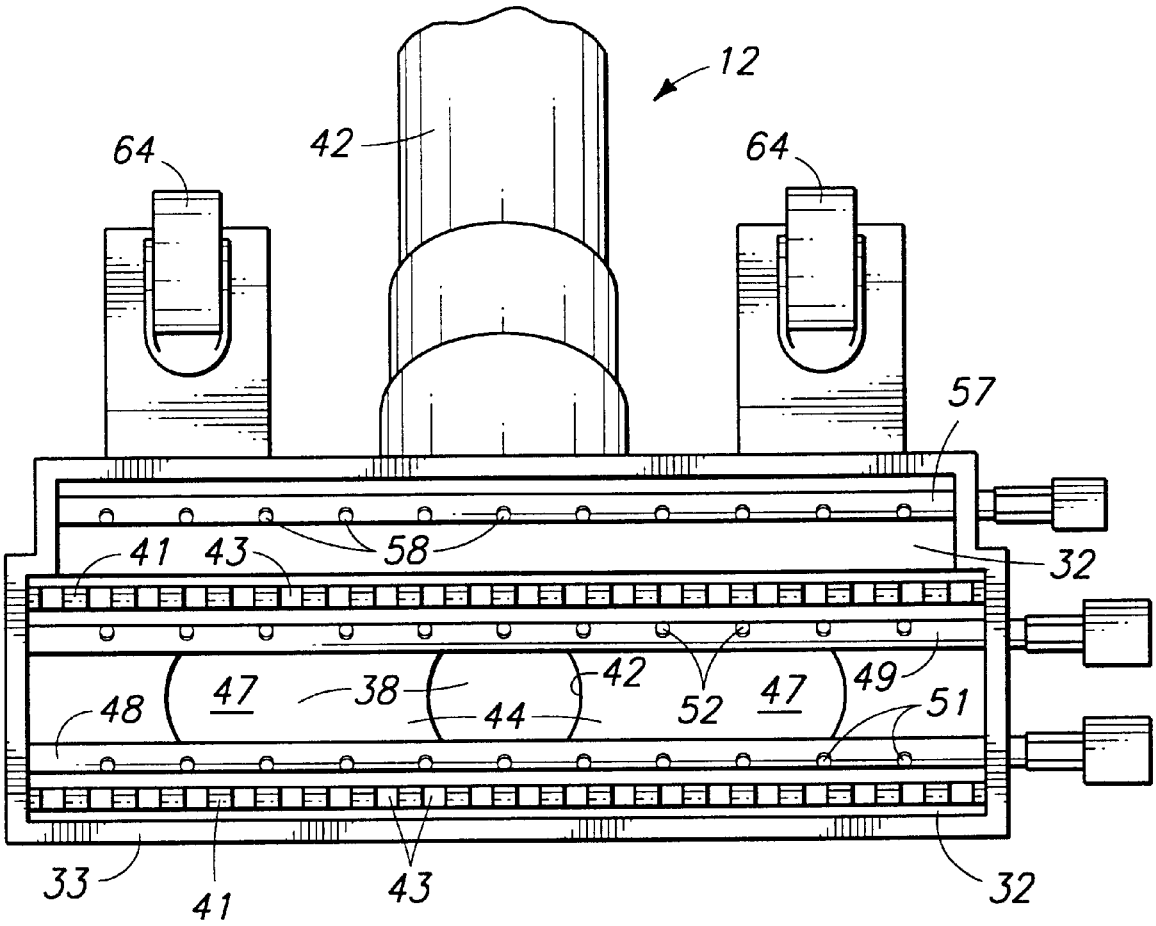
FIG. 8 is a bottom plan,view of the preferred cleaning head.
Figure 9:
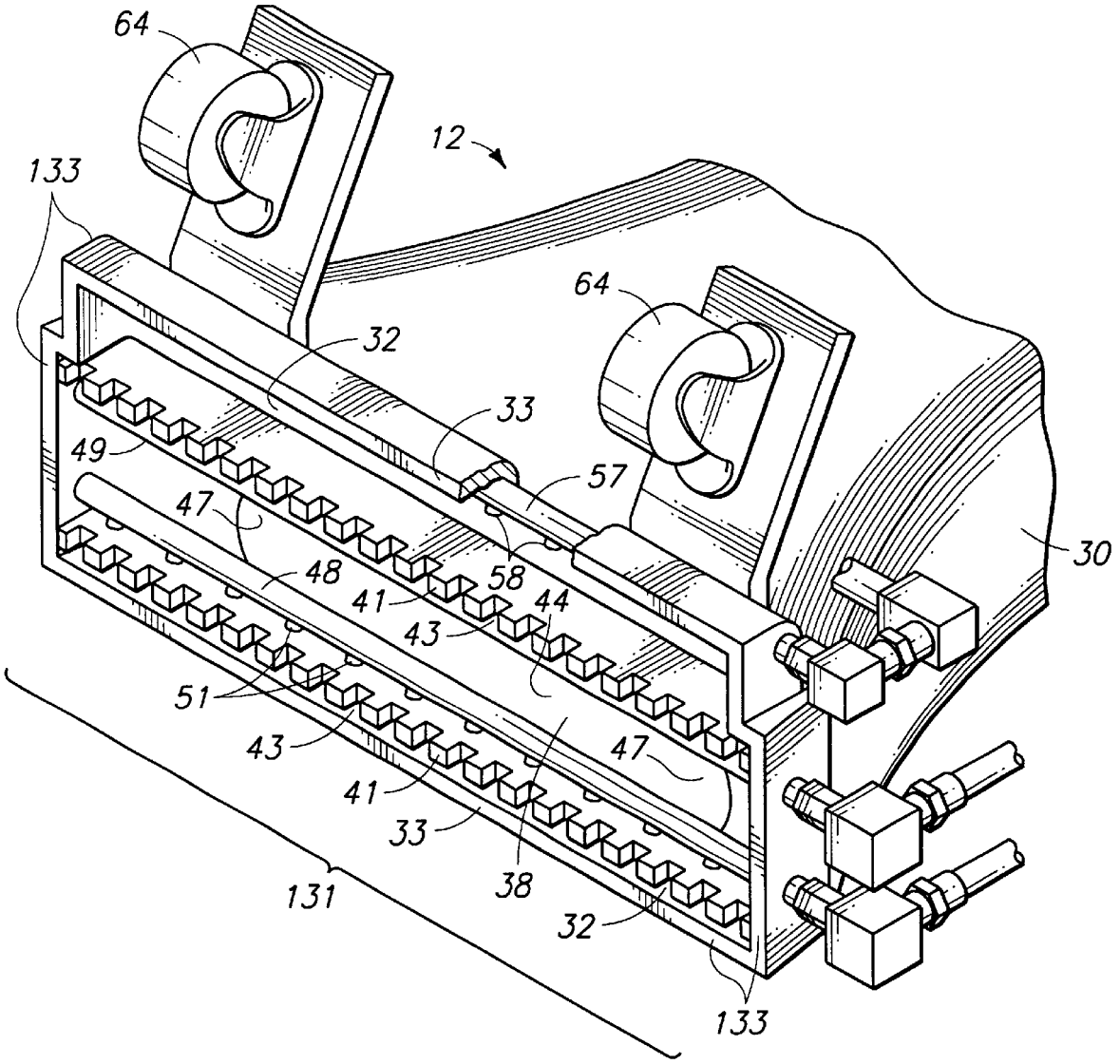
FIG. 9 is a fragmented perspective view of the cleaning head as viewed from below.

The cleaning head utilizes housing 30 to provide an operational face 131 which is best shown in FIGS. 7–9. This operational face is along an open bottom end of the housing. In operation the face is placed adjacent to and in juxtaposition with a carpet or other surface being cleaned (see FIG. 6). As shown, the cleaning head housing 30 has an outer or perimeter wall 133 which is about most or all of the operational face. The operational face is open along the bottom side of the housing to allow cleaning fluids, and drying and agitating gases to be applied to the surface being cleaned. The open operational face also allows debris, and the cleaning and drying fluids to be removed in a manner which cleans the carpet or other surface being cleaned. The operational face and other features of the invention also allow the carpet or other surface to be largely dried simultaneously with the cleaning procedure to significantly reduce or eliminate the drying time.

The outer or perimeter wall 133 serves to define or outline a working area therewithin which is across most or all of the open operational face. The outer wall 133 restricts air flow between ambient air which is outside of the outline of the perimeter wall and the working area which is within that outline. Although the bottom edge of the perimeter wall is preferably straight and even in the embodiment shown, alternative edge treatments may be satisfactory to allow the working area to be sufficiently restricted or confined when the face of the cleaning head is placed into an operational position against or facing the surface being cleaned.

In the case of use on carpeted surfaces, the bottom edge of the outer housing wall forms a close or contacting relationship with the flexible carpet fibers and the possible flow of air between ambient areas and the working area is sufficiently restricted to allow the novel cleaning processes of this invention to be performed within the working area. Although this perimeter restriction does not need to be sealed against the floor or other surface, the outer wall is most preferably circuitous or approximately circuitous along a contact face which is adjacent to the carpet or other surface being cleaned to provide some restriction of air flow between the working area and the ambient air. The outer wall 133 also serves to help confine the working area within the outline of the outer wall so that desired flows within the working area are maintained as described more fully below.

The figures show that housing 30 can in a preferred form of the invention be formed as a hollow bell-shaped unit with an enclosed vacuum or intake plenum 32. In operation, the intake plenum is substantially confined except at the open operation face. The intake plenum defines at least one vacuum zone therewithin which is applied at the operational face to the surface being cleaned. The vacuum zone or zones are areas in which a significant vacuum pressure is developed across the face of the cleaning head so that debris and fluids are picked up and conveyed by the vacuum and associated outflow from the cleaning head.

The housing 30 serves to form and largely confine the uptake or intake plenum 32 within which vacuum pressures are developed. The intake plenum or passageway leads from the opening formed along the face of the cleaning head to a vacuum line or outflow connector 34. Connector 34 is adapted to mount an end of the vacuum hose line 25. In a preferred form, the connector 34 is extended to form or mount a handle for use by the operator as shown in FIG. 1.

Thus vacuum force produced by the vacuum pump 18 will induce air movement into and through the plenum 32 to the hose 25 and eventually to the vacuum pump 18. Arrows shown in FIG. 6 show this movement.

The cleaning head also includes one or more areas which are provided with drying gas. The drying gas areas are open along the operational face and are intended to provide a pressurized zone or zones which form part of the working area. The pressurized zone formed within the drying gas chamber or area is preferably provided using a hot air discharge housing 36. The hot air discharge housing 36 is advantageously situated within or at least partially within the hollow bell-shaped vacuum housing 30. Hot air discharge housing 36 is also bell-shaped and forms a hot air discharge plenum 38 that is enclosed on its sides by a partition wall or walls, such as zone partition walls 40. Zone partition walls 40 serve to form a restrictive partition between the pressure zone within discharge plenum 38 and the vacuum zones within intake plenum 32. The discharge plenum is advantageously within or partially within the intake plenum 32. The wall 40 (and plenum 38) leads from an open bottom end 41 to a hot air connector 42. The open bottom end 41 is substantially circumscribed (and preferably coplanar with) the open bottom end 33 of the hollow bell-shaped vacuum housing 30.

Figure 5:
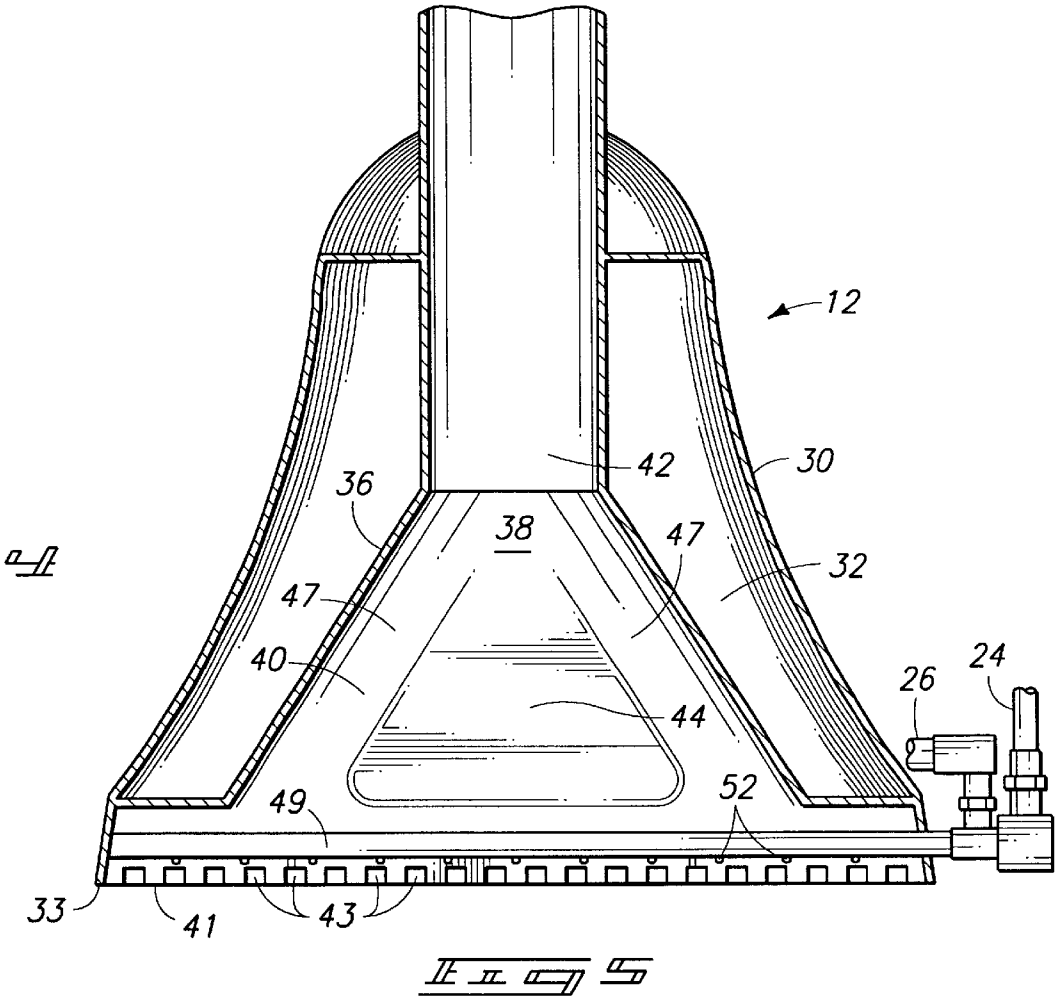
FIG. 5 is an enlarged cross-sectional view taken substantially along line 5—5 in FIG. 3.
Figure 4:
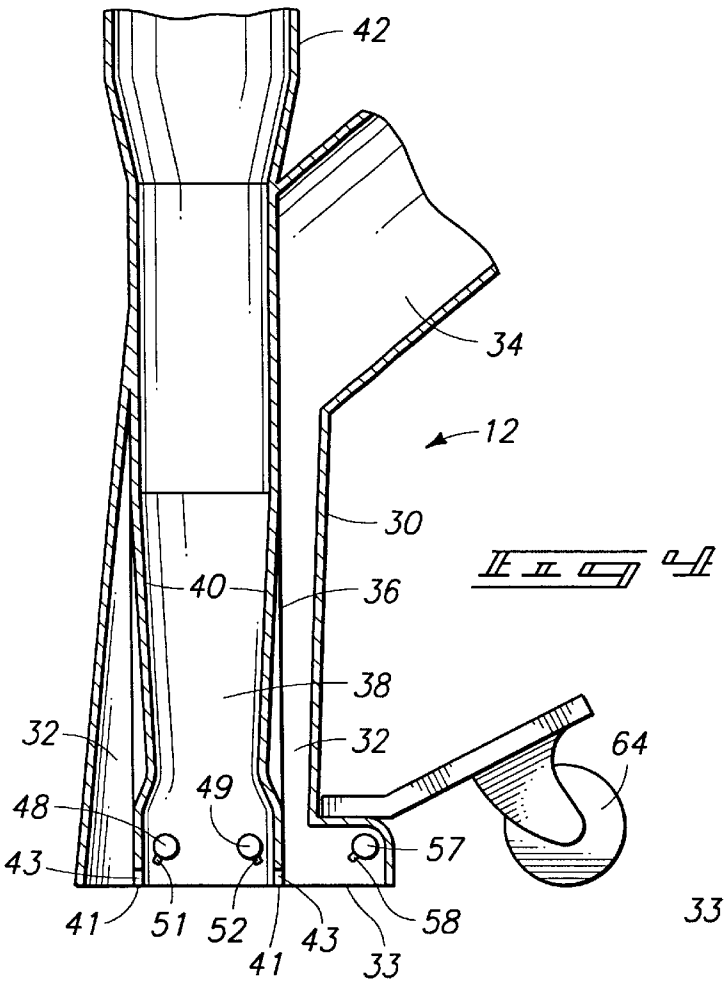
FIG. 4 is an enlarged cross-sectional view taken substantially along line 4—4 in FIG. 2.

As shown in FIGS. 4 and 5, the preferred hot air housing 36 is integral with the bell-shaped vacuum housing 30. This may be done by conventional casting or welding methods. However it is also possible that the two housings be separate, then assembled in the manner described.

In preferred forms, a hot air blower 39 is mounted directly on the cleaning head. More specifically, the hot air blower 39 is mounted to the hot air housing 36 by way of the hot air connector 42. The hot air blower 39 is operable to direct a stream of heated air under positive pressure downwardly through the hot air discharge plenum 38. This heated air will impinge on the surface being cleaned (see arrows in FIG. 6), and be simultaneously drawn outwardly of the wall 40 at the open bottom end 41 and into the intake plenum 32 which surrounds the hot air housing. This air movement, from positive air pressure within the hot air discharge plenum to the negative pressure produced within the vacuum housing is an advantage in operation of the present cleaning head as will be better understood later in this description.

The desired amount of flow of hot air or other drying gas from the pressure or discharge plenum 38 into the uptake or vacuum plenum 32 occurs over the contact edge of the partition walls 40. This movement or flow of gas and debris is assisted by providing castellations or crenelations 43 (best viewed in FIG. 9). These features are formed along the partition walls 40 along the open bottom end 41 of the hot air housing 36. The castellations 43 minimize the possibility that a tight seal might develop between the bottom end 41 of wall 40 and the surface being cleaned, and thereby assure the desired degree of airflow for both cleaning and drying of the carpet or other surface.

Uniform hot air dispersion along the castellated wall edge is assisted by shaping the wall above the castellations substantially as shown in FIG. 7. A reduced cross-sectional area 44 is provided adjacent to the central part of the hot air discharge plenum. Enlarged open areas 47 adjoin the area 44, leading inwardly (FIG. 5) to the hot air connector tube 42. This configuration encourages the hot pressurized air delivered by the central hot air connector 42 to spread evenly through the plenum and to discharge evenly along the bottom end 40. It has been found that without the above plenum wall configuration, a column of hot pressurized air will be discharged in a concentrated central area directly below the connector tube 42 of the plenum with a resulting negative effect on cleaning and drying efficiency.

The hot air blower 39 is preferably comprised of an enclosed electric fan or blower 45 which is operable to produce an airflow across an electrical resistance heater 46. The hot air blower 39 may be of a conventional form, producing a discharged air temperature of at least approximately 200 degrees F. and an air movement of approximately 90 cfm. It is preferred that the hot air blower be adjustable to allow variance in temperature of the discharge air. Such adjustments are conventionally available and will enable the user to selectively adjust the temperature according to the surface to be cleaned and dried.

It is advantageous that the hot air blower 39 be mounted directly to the cleaning head 12. Air warmed by the blower will not have an opportunity to cool before impinging on the surface to be cleaned. Thus, the hot air blower need not be required to over-heat air to compensate for cooling along a long feed line. Also mounting the hot air blower 39 to the cleaning head 12 eliminates the need for another hose extending to the van.

At least one and preferably two compressed air injection conduits or lines 48, 49 are positioned within the hot air housing 36. The lines 48 extend along the length of the hot air housing and include spaced compressed air discharge openings or nozzles 51, 52 respectively. The openings or nozzles 51, 52 are angularly oriented to discharge compressed air downwardly and angularly toward the intake plenum 32. The nozzles 51, 52 may be commercially available fan type nozzles which may be interchangeable with other nozzles of different outlet size or shape to vary airflow volume or pattern if desired.

The conduits or lines 48, 49 are connected, using common high pressure connectors to the pressure hose 24 which leads to the air pressure pump 20 in the carrier vehicle 16. An air drier and pressure regulator 54, and a pressure gauge 55 are preferably connected in the pressure hose 24 at the cleaning head to enable removal of water from the hose, and accurate adjustment of the air pressure. The hose 24 includes two lead lines that extend between the regulator 54 and the lines 48, 49. A conventional hand-operated control 66 may be connected along the air pressure hose 24, preferably at the handle (FIG. 1) to allow the operator selective air control.

In a preferred form, the cleaning head 12 also includes a cleaning fluid or liquid discharge tube 57. The cleaning fluid discharge tube is arranged to discharge a suitable cleaning fluid or fluids within the working area and applied upon the surface being cleaned. As shown, the discharge tube 57 is positioned within the intake plenum 32 adjacent the bottom end 33. It alternatively could be located within the pressurized zone for discharge therein. The fluid discharge 57 includes fluid discharge openings or nozzles 58. The nozzles 58 are preferably spaced along the fluid discharge tube 57 and are oriented to direct fluid downwardly and angularly toward the surface, such as toward the bottom end 41 of the hot air discharge plenum 38. The air discharge openings 52 of one compressed air injection line 49 and the fluid discharge openings 58 are advantageously angularly convergent, as shown in FIG. 4.

The angular orientation of the nozzles is such that cleaning fluid sprayed or otherwise discharged onto the surface being cleaned will be picked up by the air current running from the pressurized hot air discharge and be pulled into the vacuum pressures existing within the intake plenum 32. Thus a high flow rate can be used for greater cleaning efficiency without leaving an excessively wet surface.

It is also noted that the cleaning fluid nozzles need not be used. This may well be a preferred operation when it is desired simply to dry a wet surface area (such as a flooded carpet). Cleaning action will occur automatically as the high pressure and heated air flows cause turbulence and drying of the surface while the vacuum pulls moisture and loose debris from the surface adjacent to the working area.

The fluid discharge tube 57 connects to the fluid pressure hose 26 by way of conventional fittings, which also mount a water pressure gauge 60. A conventional manually operable valve 67 is connected along the fluid hose 26 at the handle to allow the user to vary or stop the flow rate of fluid through the nozzles 58.

It is also pointed out that the nozzles 58 may be removed and replaced with other nozzles of different opening size or spray patterns, depending upon the surface to be cleaned. For carpets, fan nozzles are preferred for saturation of the carpet fabric. Jet nozzles may be preferred for cleaning hard surfaces.

From the above description, operation of the present invention may now be easily understood. An exemplary operation will be described in connection with cleaning of a carpet. It should be noted however that the present invention may be used for cleaning, drying, or stripping other forms of surfaces. Operation of the present invention and its structure will remain substantially the same though scale may vary.

For operation of the present invention as a carpet cleaner, attention is in particular directed to FIGS. 1 and 6 of the drawings.

Prior to operation, the system is transported to the site to be cleaned and the various connections are made to set the system in order for operation. This may entail connection of the various elements requiring electrical power (such as the hot air blower 39) to a conventional source of electrical energy. Others of the units may be powered independently from within the carrier vehicle 16 by conventional power sources. The desired pressure and vacuum lines are also connected between the cleaning head and the respective pressure sources carried in the van. Pressure adjustments are made according to the work to be done.

For example, if the user is to clean a low shag carpet constructed of synthetic materials, the fluid discharge and compressed injection air pressures are adjusted accordingly.

An operating pressure for the compressed injection air lines might be set at 60 psi., and temperature of the air from the hot air blower may also be adjusted to approximately 200°–250° F. Water flow (and any additives) might also be adjusted to 2 gpm at 200 psi. Adjustment of water flow is preferably completed after the vacuum, hot air blower, and the air pressure pump are activated.

Cleaning the carpet is accomplished in a manner similar to conventional carpet cleaning or vacuuming. As shown in FIG. 1, the cleaning head is simply moved back and forward on the carpet, covering all areas to be cleaned. To this end, rollers or wheels 64 may be provided on the back side of the cleaning head. The wheels allow the unit to be tipped rearwardly to engage the wheels with the support surface and allow the head to be moved to a desired location. Then, when in position, the unit may be tipped back upwardly (to the position shown in FIG. 1) so the bottom housing ends 33, 41 rest substantially flush on the carpet surface. Now the head can be pulled or pushed to perform the cleaning function. The controls 66, 67 at the handle may be selectively operated by the user to control air injection feed and water discharge as desired.

As the cleaning head is moved, several operations occur continuously.

Vacuum pressure produced by the vacuum pump 18 is continuously applied, drawing air, moisture and debris through the vacuum housing and into the vacuum hose to the external vacuum source where conventional filtering and collecting equipment collect the soiled materials. This cleaning action alone would ordinarily resemble operation of a conventional commercial or industrial vacuum cleaner. However, additional functions are also employed simultaneously with the vacuuming action to more thoroughly clean the carpet fibers.

The hot air blower will be functioning at this time to blow heated air against the carpet surface within the confines defined by the bottom end of the hot air pienum. The heated air impinges against the carpet, then is drawn through the castellations 43 and into the vacuum plenum.

The high volume of heated air causes increased evaporation and drying of the carpet fibers. This heated air movement is substantially supplemented by the jets of compressed injection air discharging from the high pressure air injection lines 48, 49. The pressurized air, discharging at 60 psi, and angularly oriented toward the castellated edges of the hot air plenum, will agitate the carpet fibers and carry the heated air through and under the castellations into the vacuum plenum. These two actions result in intermixed positive pressure air streams that will loosen and carry debris along toward the vacuum plenum, where the inwardly moving air current created by the vacuum pump will draw both streams and debris out through the vacuum hose.

The heated air applied under positive pressure moves downwardly through the carpet fibers toward a negative pressure in the vacuum plenum. This positive to negative transition produces a rush of air through the carpet that has a significant effect on cleaning and drying of the carpet fibers by agitating the fibers, passing relatively large volumes of drying gases therethrough, and by increasing the efficiency of the vacuum.

While the above airstreams operate, the fluid discharge may also be functioning (if desired) to produce a spray of fluid such as water (which may be mixed with detergents, etc.) against the carpet. The spray or other discharging flow of cleaning fluids is directed angularly toward the bottom end of the hot air discharge plenum. The spray also agitates the carpet fibers and the fluid itself will dissolve or loosen debris from the carpet. The water will be quickly picked up by the vacuum stream and what remains may be evaporated in the rush of heated air moving through the carpet fibers to the vacuum intake plenum. Thus the carpet is both cleaned and substantially dried effectively and efficiently in the same operation.

As can be appreciated from the description given above, the invention also includes novel methods and processes for vacuum cleaning of surfaces, such as floors, and particularly carpets. In particular the invention is directed to the efficient combined cleaning and drying of carpeted floor surfaces. The cleaning of carpeted floors is a major commercial activity. It has in the past been plagued by the problem of the carpeted surfaces being left wet after the cleaning has been performed. It will also be appreciated by everyone that it is frequently very difficult to clean carpeted surfaces to the desired degree. This is typically true because the millions of thin fibers used to make up the carpeted surface are easy to pick up dirt and stains which are difficult to fully remove due to the large number of minute surfaces existing upon the carpet fibers.

Novel methods according to the invention preferably include forming a working area along a face of a cleaning head when the cleaning head is placed in an operational position facing a surface being cleaned. The working area is preferably at least partially enclosed or totally enclosed by an outer wall which restricts airflow between the ambient area and the working area which exists within the outline of the outer or perimeter wall. The working area preferably includes at least one pressure zone therewithin, and at least one vacuum zone therewithin.

The preferred methods also include providing a pressurized drying gas to at least one pressure zone. The pressurized drying gas is preferably heated. The heated condition of this gas serves to improve performance of the methods in several significant respects. Firstly, the heated drying gas increases the cleaning efficiency of the cleaning processes because the carpet or other surface being cleaned is better able to be freed of grease and oils at the higher temperatures. The higher temperatures also serve with the preferred application of heated cleaning fluids, such as hot water and detergent solutions, by keeping those solutions at a higher temperature while the cleaning fluids are in the carpet fibers. This is significant for improved cleaning, dislodgement of debris, and removal of stains such as notorious combinations of greases and dirts which resist cleaning. Heated gases are of foremost significance in speeding the volatilization and drying of water and any other liquids which may be applied during cleaning. Also, when the system is used to remove floodwater or other liquid, the drying gas greatly speeds volatilization of these liquids from the carpet or other surface.

Methods according to this invention also preferably include jetting or otherwise discharging pressurized gas against the surface being cleaned. This is preferably accomplished from jets emitting within the working area, and more preferably within said at least one pressure zone. This discharging and jetting action is significant in greatly speeding the drying rate. This is of particular significance with regard to methods for drying carpet, or both cleaning and drying carpet. The jetting action is also significant in agitating carpet fibers and other surfaces being cleaned to help by dislodging particles and liquids therefrom. The use of high pressure jets of drying and agitating gas further is important in providing relatively large volume flow rates which help to carry away the moisture which aids in the drying process.

The methods further preferably include passing the pressurized drying gas over at least one zone partition wall extending between the pressure zone or zones and the vacuum zone or zones. The preferred passing of the pressurized drying gas or gases causes the gases to move along the surface and this increases the potential for dislodgement of debris and liquids, and also speeds drying. This step can be effected by passing the pressurized gas over a zone partition wall which is intermittently open, such as at the crenelations discussed above. This facilitates continued but controlled air flow rates even though the cleaning head may be in close proximity and flow of air between the pressure and vacuum zones would otherwise be too restricted.

Methods according to the invention can further include discharging a cleaning fluid, such as chemicals, water and detergent, or others within the working area. This leads to applying the cleaning fluids to the surface being cleaned because the fluids are released into the working area and are communicated to the surface by the turbulence of the rushing gases, or by directly spraying the cleaning fluids upon the surface.

Methods according to the invention further include evacuating or withdrawing gases and debris from the vacuum zone or zones. The evacuating is effective at removing pressurized gases supplied to the pressure zones to remove the drying gas, debris and any other fluids from the at least one vacuum zone and adjacent surface being cleaned. The removed gases, fluids and debris can then be suitably contained and disposed of as the situation warrants. In the typical carpet cleaning situation contemplated herein, the gases can be released and the liquid and debris is contained within a soiled water container and properly handled for ultimate disposal.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A vacuum system cleaning head, comprising:

a hollow vacuum housing forming an intake plenum leading from an open bottom end of the hollow vacuum housing to a vacuum line connector;

a hot air housing situated at least partially within the hollow vacuum housing and including a hot air discharge plenum defined by a wall within the intake plenum and leading to a hot air connector from an open bottom end that is substantially circumscribed by the open bottom end of the hollow vacuum housing;

at least one hot air blower on the hot air housing, said hot air blower having a heater to heat air passing therethrough;

at least one fluid discharge within the intake plenum for directing fluid toward said open bottom end of the vacuum housing.

2. The vacuum system cleaning head of claim 1 wherein the open bottom ends of the intake plenum and hot air housing are substantially coplanar.

3. The vacuum system cleaning head of claim 1 further comprising a fluid discharge tube positioned within the intake plenum adjacent the open bottom end thereof and including fluid discharge openings oriented to direct fluid downwardly and angularly toward the open bottom end of the hot air discharge plenum.

4. The vacuum system cleaning head of claim 1 further comprising a fluid discharge tube on the hollow vacuum housing and including fluid discharge openings oriented to direct fluid downwardly toward the open bottom end of the hollow vacuum housing.

5. The vacuum system cleaning head of claim 1 further comprising a fluid discharge tube positioned within the intake plenum adjacent the open bottom end thereof and including fluid discharge openings oriented to direct fluid downwardly and angularly toward the open bottom end of the hot air discharge plenum.

6. The vacuum system cleaning head of claim 1 wherein the hollow vacuum housing and the hot air housing are integral.

7. A vacuum system cleaning head, comprising:

a hollow vacuum housing forming an intake plenum leading from an open bottom end of the hollow vacuum housing to a vacuum line connector;

a hot air housing situated at least partially within the hollow vacuum housing and including a hot air discharge plenum defined by a wall within the intake plenum and leading to a hot air connector from an open bottom end that is substantially circumscribed by the open bottom end of the hollow vacuum housing;

at least one hot air blower on the hot air housing, said hot air blower having a heater to heat air passing therethrough;

wherein the wall of the hot air housing includes a bottom edge defining the open bottom end of the hot air housing and wherein the bottom edge is castellated.

8. A vacuum system cleaning head, comprising:

a hollow vacuum housing forming an intake plenum leading from an open bottom end of the hollow vacuum housing to a vacuum line connector;

a hot air housing situated at least partially within the hollow vacuum housing and including a hot air discharge plenum defined by a wall within the intake plenum and leading to a hot air connector from an open bottom end that is substantially circumscribed by the open bottom end of the hollow vacuum housing;

at least one hot air blower on the hot air housing, said hot air blower having a heater to heat air passing therethrough;

wherein the hot air blower is mounted on the hot air housing at the hot air connector to direct a stream of heated air downwardly through the hot air discharge plenum; and wherein the intake plenum is formed about the hot air housing to receive heated air from the hot air plenum.

9. A vacuum system cleaning head, comprising:

a hollow vacuum housing including an intake plenum leading from an open bottom end of the hollow vacuum housing to a vacuum line connector;

a hot air housing situated at least partially within the hollow vacuum housing and including a hot air discharge plenum defined by a wall within the intake plenum and leading from a hot air connector to an open bottom end that is substantially circumscribed by the intake plenum;

at least one hot air blower on the hot air housing said hot air blower having a heater to heat air passing therethrough; and a fluid discharge positioned within the intake plenum adjacent the bottom end of the hollow vacuum housing and including fluid discharge openings oriented to direct fluid downwardly and angularly toward the bottom end of the hot air discharge plenum.

10. The vacuum system cleaning head of claim 9, wherein the bottom edge of said wall is castellated.

11. A vacuum system, comprising:

a hollow vacuum housing including an intake plenum leading from an open bottom end of the housing to a vacuum line connector;

a vacuum pump attached to the vacuum line connector;

a hot air housing situated at least partially within the hollow vacuum housing and including a hot air discharge plenum defined by a wall within the intake plenum and leading from an open bottom end that is substantially circumscribed by the intake plenum;

a hot air blower on the hot air housing;

an air pressure pump connected to the at least one compressed injection air discharge line;

a fluid discharge line positioned within the intake plenum adjacent the bottom end and including fluid discharge openings oriented to direct fluid downwardly and angularly toward the bottom end of the hot air discharge plenum and;

a fluid discharge pump connected to the fluid discharge line.

12. The vacuum system cleaning head of claim 11 wherein the hot air blower is configured to deliver air at approximately 100° F. to approximately 1500° F.

13. The vacuum system cleaning head of claim 11 wherein the hot air blower is configured to deliver air at approximately 200° F. to approximately 250° F.

14. A vacuum cleaning system for cleaning surfaces such as floors, carpets, or other surface being cleaned, comprising:

a cleaning head having:

a cleaning head outer wall which restricts airflow between ambient air and a working area along a face of the cleaning head when the cleaning head is placed in an operational position facing the surface being cleaned;

at least one pressure zone within the working area, said at least one pressure zone being supplied with drying gas;

at least one hot air blower which receives ambient air not recycled from the working area and discharges a heated stream of drying gas within the at least one pressure zone and against the surface being cleaned;

at least one vacuum zone within the working area, said at least one vacuum zone being subjected to a vacuum pressure which causes debris and fluids to be removed from the surface along the face of the cleaning head;

at least one zone partition wall extending between the at least one pressure zone and the at least one vacuum zone, said at least one zone partition wall serving to guide drying gas to flow adjacent the surface being cleaned as the drying gas flows about the at least one zone partition wall between the pressure zone to the vacuum zone.

15. A vacuum cleaning system for cleaning surfaces such as floors, carpets, or other surface being cleaned, comprising:

a cleaning head having:

a cleaning head outer wall which restricts airflow between ambient air and a working area along a face of the cleaning head when the cleaning head is placed in an operational position facing the surface being cleaned;

at least one pressure zone within the working area, said at least one pressure zone being supplied with drying gas;

at least one hot air blower which discharges a heated stream of drying gas within the at least one pressure zone and against the surface being cleaned;

at least one vacuum zone within the working area, said at least one vacuum zone being subjected to a vacuum pressure which causes debris and fluids to be removed from the surface along the face of the cleaning head;

at least one zone partition wall extending between the at least one pressure zone and the at least one vacuum zone, said at least one zone partition wall serving to guide drying gas to flow adjacent the surface being cleaned as the drying gas flows about the at least one zone partition wall between the pressure zone to the vacuum zone;

wherein the drying gas supplied to the pressure zone is not recirculated from the at least one vacuum zone.

16. A vacuum cleaning system according to claim 14 wherein the cleaning head further includes:

at least one cleaning fluid discharge opening for discharging cleaning fluid within the working area for application to the surface being cleaned.

17. A vacuum cleaning system according to claim 16 and further comprising a cleaning fluid source for providing a cleaning fluid to said at least one cleaning fluid discharge opening.

18. A vacuum cleaning system for cleaning surfaces such as floors, carpets, or other surface being cleaned, comprising:

a cleaning head having:

a cleaning head outer wall which restricts airflow between ambient air and a working area along a face of the cleaning head when the cleaning head is placed in an operational position facing the surface being cleaned;

at least one pressure zone within the working area, said at least one pressure zone being supplied with drying gas;

at least one hot air blower which discharges a heated stream of drying gas within the at least one pressure zone and against the surface being cleaned;

at least one vacuum zone within the working area, said at least one vacuum zone being subjected to a vacuum pressure which causes debris and fluids to be removed from the surface along the face of the cleaning head;

at least one zone partition wall extending between the at least one pressure zone and the at least one vacuum zone, said at least one zone partition wall serving to guide drying gas to flow adjacent the surface being cleaned as the drying gas flows about the at least one zone partition wall between the pressure zone to the vacuum zone;

wherein there are plural vacuum zones adjacent to said at least one pressure zone.

19. A vacuum cleaning system for cleaning surfaces such as floors, carpets, or other surface being cleaned, comprising:

a cleaning head having:

a cleaning head outer wall which restricts airflow between ambient air and a working area along a face of the cleaning head when the cleaning head is placed in an operational position facing the surface being cleaned;

at least one pressure zone within the working area, said at least one pressure zone being supplied with drying gas;

at least one hot air blower which discharges a heated stream of drying gas within the at least one pressure zone and against the surface being cleaned;

at least one vacuum zone within the working area, said at least one vacuum zone being subjected to a vacuum pressure which causes debris and fluids to be removed from the surface along the face of the cleaning head;

at least one zone partition wall extending between the at least one pressure zone and the at least one vacuum zone, said at least one zone partition wall serving to guide drying gas to flow adjacent the surface being cleaned as the drying gas flows about the at least one zone partition wall between the pressure zone to the vacuum zone;

wherein said at least one partition wall is crenelated along a face edge which is adjacent to the surface being cleaned.

20. A vacuum cleaning system for cleaning surfaces such as floors, carpets, or other surface being cleaned, comprising:

a cleaning head having:

a cleaning head outer wall which restricts airflow between ambient air and a working area along a face of the cleaning head when the cleaning head is placed in an operational position facing the surface being cleaned;

at least one pressure zone within the working area, said at least one pressure zone being supplied with drying gas;

at least one hot air blower which discharges a heated stream of drying gas within the at least one pressure zone and against the surface being cleaned;

at least one vacuum zone within the working area, said at least one vacuum zone being subjected to a vacuum pressure which causes debris and fluids to be removed from the surface along the face of the cleaning head;

at least one zone partition wall extending between the at least one pressure zone and the at least one vacuum zone, said at least one zone partition wall serving to guide drying gas to flow adjacent the surface being cleaned as the drying gas flows about the at least one zone partition wall between the pressure zone to the vacuum zone;

and further comprising a vacuum source for generating a vacuum and removing fluids and debris from the at least one vacuum zone.

21. A vacuum system cleaning head, comprising:

at least one vacuum housing having at least one intake opening which is open to pick up debris and fluids from a surface being cleaned;

at least one hot air housing having at least one hot air discharge opening;

at least one air heater for supplying heat to the at least one hot air housing;

at least one operational face which includes the at least one intake opening and the at least one hot air discharge opening;

and wherein the at least one hot air housing uses substantially ambient air not recirculated from said at least one vacuum housing.

22. A vacuum system cleaning head according to claim 21 and further comprising the at least one outer wall substantially surrounding: the at least one hot air discharge opening and the at least one intake opening.

23. A vacuum system cleaning head according to claim 21 and further comprising at least one cleaning fluid discharge opening mounted on said cleaning head.

24. A vacuum system cleaning head according to claim 21 and further comprising:

the at least one cleaning fluid discharge opening;

the at least one outer wall substantially surrounding the at least one hot air discharge opening and the at least one intake opening.

25. A vacuum system cleaning head according to claim 21 and further comprising:

the at least one cleaning fluid discharge opening;

the at least one outer wall substantially surrounding the at least one hot air discharge opening, the at least one intake opening, and the at least one cleaning fluid discharge opening.

26. A vacuum system cleaning head according to claim 21 and further comprising at least one cleaning fluid discharge opening, said at least one cleaning fluid discharge opening being positioned upon the operational face approximately within the at least one intake opening.

27. A vacuum system cleaning head according to claim 21 wherein there are plural intake opening positioned about the at least one hot air discharge opening.

28. A vacuum system cleaning head according to claim 21 wherein the at least one intake opening substantially surrounds the at least one hot air discharge opening.

29. A vacuum system cleaning head according to claim 21 wherein the at least one hot air housing receives ambient air from outside the vacuum system cleaning head.

30. A vacuum system cleaning head according to claim 21 wherein the at least one hot air housing receives ambient air which is substantially free of air recirculated from the vacuum housing.

31. A vacuum system cleaning head according to claim 21 and further comprising at least one hot air blower for forcing air from the at least one hot air discharge opening.

32. A vacuum system cleaning head, comprising:

at least one vacuum housing having at least one intake opening which is open to pick up debris and fluids from a surface being cleaned;

at least one hot air housing having at least one hot air discharge opening, said at least one hot air housing being configured to receive ambient air from outside the vacuum system cleaning head which is substantially free of air recirculated from the vacuum housing;

at least one air heater for supplying heat to the at least one hot air housing;

at least one operational face which includes the at least one intake opening and the at least one hot air discharge opening.

33. A vacuum system cleaning head according to claim 32 and further comprising at least one cleaning fluid discharge opening mounted on said cleaning head.

34. A vacuum system cleaning head according to claim 32 and further comprising:

at least one cleaning fluid discharge opening;

at least one outer wall substantially surrounding the at least one hot air discharge opening and the at least one intake opening.

35. A vacuum system cleaning head according to claim 32 and further comprising:

at least one cleaning fluid discharge opening;

at least one outer wall substantially surrounding the at least one hot air discharge opening, the at least one intake opening, and the at least one cleaning fluid discharge opening.

36. A vacuum system cleaning head according to claim 32 and further comprising at least one cleaning fluid discharge opening, said at least one cleaning fluid discharge opening being positioned upon the operational face approximately within the at least one intake opening.

37. A vacuum system cleaning head according to claim 32 wherein there are plural intake openings positioned about the at least one hot air discharge opening.

38. A vacuum system cleaning head according to claim 32 wherein the at least one intake opening substantially surrounds the at least one hot air discharge opening.

39. A vacuum system cleaning head according to claim 32 and further comprising at least one hot air blower for forcing air from the at least one hot air discharge opening.

40. A vacuum cleaning system, comprising:

a vacuum system cleaning head, including:

at least one vacuum housing having at least one intake opening which is open to pick up debris and fluids from a surface being cleaned;

at least one hot air housing which receives ambient air for discharge from at least one hot air discharge opening;

at least one air heater for supplying heat to the at least one hot air housing;

at least one operational face which includes the at least one intake opening and the at least one hot air discharge opening;

a vacuum pump connected to the at least one vacuum housing to provide a vacuum thereto.

41. A vacuum cleaning system, comprising:

a vacuum system cleaning head, including:

at least one vacuum housing having at least one intake opening which is open to pick up debris and fluids from a surface being cleaned;

at least one hot air housing having at least one hot air discharge opening;

at least one air heater for supplying heat to the at least one hot air housing;

at least one operational face which includes the at least one intake opening and the at least one hot air discharge opening;

a vacuum pump connected to the at least one vacuum housing to provide a vacuum thereto; and at least one outer wall substantially surrounding: the at least one hot air discharge opening, and the at least one intake opening.

42. A vacuum cleaning system according to claim 40 and further comprising:

at least one cleaning fluid discharge opening mounted on said cleaning head;

at least one cleaning fluid supply pump.

43. A vacuum cleaning system according to claim 40 and further comprising:

at least one cleaning fluid discharge opening mounted on said cleaning head;

at least one cleaning fluid supply pump;

at least one outer wall substantially surrounding the at least one hot air discharge opening and the at least one intake opening.

44. A vacuum cleaning system according to claim 40 and further comprising:

at least one cleaning fluid discharge opening mounted on said cleaning head;

at least one cleaning fluid supply pump;

at least one outer wall substantially surrounding the at least one hot air discharge opening, the at least one intake opening, and the at least one cleaning fluid discharge opening.

45. A vacuum cleaning system according to claim 40 and further comprising:

at least one cleaning fluid discharge opening, said at least one cleaning fluid discharge opening being positioned upon the at least one operational face at least partially within the at least one intake opening;

at least one cleaning fluid supply pump.

46. A vacuum cleaning system according to claim 40 wherein there are plural of said at least one intake opening positioned upon the operational face about the at least one hot air discharge opening.

47. A vacuum cleaning system according to claim 40 wherein the at least one intake opening substantially surrounds the at least one hot air discharge opening.

48. A vacuum cleaning system according to claim 40 wherein the at least one hot air housing receives ambient air from outside the vacuum system cleaning head.

49. A vacuum cleaning system according to claim 40 wherein the at least one hot air housing receives ambient air which is substantially free of air recirculated from the vacuum housing.

50. A vacuum cleaning system according to claim 40 and further comprising at least one hot air blower for forcing air from the at least one hot air discharge opening.

51. A surface cleaning and drying system, such as for cleaning carpets or floors, comprising:

at least one cleaning head which has an operational face with a working area that is positioned adjacent to a surface being cleaned, said at least one cleaning head including:

at least one intake plenum having at least one intake opening on the working area;

at least one discharge plenum having at least one discharge opening on the working area;

at least one restrictive partition between the at least one intake plenum and the at least one discharge plenum to restrict fluid flow therebetween;

at least one perimeter wall upon the operational face which at least partially encloses and restricts air flow between the working area and ambient air existing about the at least one cleaning head;

at least one drying gas blower which receives drying gas from at least one drying gas inlet and forces the drying gas through said at least one discharge opening to provide at least one pressure zone within the working area and along the surface being cleaned;

at least one drying gas heater for heating drying gas supplied through the at least one discharge opening;

at least one vacuum generator connected to draw a vacuum upon the at least one intake plenum to allow at least one vacuum zone to be developed within the working area along the surface being cleaned, said at least one vacuum generator producing an outflow containing drying gas, fluids or debris removed from the working area;

at least one outflow line in fluid communication with the intake plenum to convey said outflow therefrom to a disposal location removed from the at least one drying gas inlet.

52. A surface cleaning and drying system according to claim 51 wherein the at least one drying gas blower receives drying gas from the at least one drying gas inlet in a manner which does not include significant amounts of recirculated outflow.

53. A surface cleaning and drying system according to claim 51 wherein the at least one drying gas blower receives drying gas from the at least one drying gas inlet that is open to the ambient air.

54. A surface cleaning and drying system according to claim 51 wherein the at least one drying gas blower receives drying gas from the at least one drying gas inlet, and said at least one drying gas inlet is open to the ambient air;

and said surface cleaning and drying system does not include any structure for recirculating said outflow to the at least one drying gas inlet.

55. A surface cleaning and drying system according to claim 51 wherein the at least one drying gas blower receives drying gas from the at least one drying gas inlet in a manner which does not include said outflow.

56. A surface cleaning and drying system according to claim 51 wherein the at least one drying gas blower receives drying gas from the at least one drying gas inlet that is open to the ambient air and is constructed in a manner which does not recirculate significant amounts of said outflow.

57. A surface cleaning and drying system according to claim 51 wherein the at least one drying gas blower receives drying gas from the at least one drying gas inlet that is open to the ambient air and said at least one outflow line discharges said outflow outside of a room in which the surface cleaning and drying system is working.

58. A surface cleaning and drying system according to claim 51 wherein the at least one drying gas blower receives drying gas from the at least one drying gas inlet that is open to the ambient air and said at least one outflow line discharges said outflow outside of a building in which the surface cleaning and drying system is working.

59. A surface cleaning and drying system according to claim 51 and further comprising at least one cleaning fluid discharge for discharging a cleaning fluid within the working area for application to the surface being cleaned.

60. A surface cleaning and drying system according to claim 51 and further comprising at least one cleaning fluid discharge for discharging at least one jet of cleaning fluid within the working area for application to the surface being cleaned.

61. A surface cleaning and drying system according to claim 51 and further comprising at least one cleaning fluid discharge for discharging a jet of cleaning fluid within the working area in an orientation directed angularly downward at the surface being cleaned.

62. A surface cleaning and drying system according to claim 51 and further comprising at least one compressed gas discharge for discharging compressed gas within the working area.

63. A surface cleaning and drying system according to claim 51 and further comprising at least one compressed gas discharge for discharging a jet of compressed gas within the working area in an orientation directed angularly downward at the surface being cleaned.

64. A surface cleaning and drying system according to claim 51 and further comprising at least one compressed gas discharge for discharging compressed gas within the working area through nozzles which jet the compressed gas onto the surface being cleaned.

65. A surface cleaning and drying system according to claim 51 wherein said at least one drying gas blower is mounted upon said at least one cleaning head.

66. A surface cleaning and drying system according to claim 51 wherein said at least one drying gas blower is mounted upon said at least one cleaning head and oriented to direct a stream of heated drying gas at the surface being cleaned.

67. A surface cleaning and drying system according to claim 51 wherein said at least one drying gas heater is mounted upon said at least one cleaning head.

68. A surface cleaning and drying system according to claim 51 wherein:

said at least one drying gas heater is mounted upon said at least one cleaning head;

said at least one drying gas blower is mounted upon said at least one cleaning head.

69. A cleaning head for use in a surface cleaning and drying system, comprising:

an operational face with a working area that is positioned adjacent to a surface being cleaned;

at least one vacuum intake having at least one intake opening on the working area, said at least one vacuum intake serving to apply a vacuum to the working area through the at least one intake opening and produce an outflow therefrom containing drying gas, fluids or debris removed from the working area;

at least one drying gas discharge having at least one discharge opening on the working area through which drying gas is discharged;

at least one restrictive partition between the at least one intake opening and the at least one discharge opening to restrict fluid flow therebetween;

at least one perimeter wall upon the operational face which at least partially encloses and restricts airflow between the working area and ambient air existing about the cleaning head when the cleaning head is in an operational position;

at least one drying gas blower which receives drying gas from at least one drying gas inlet and forces the drying gas through said at least one discharge opening to provide at least one pressure zone within the working area and along the surface being cleaned;

at least one drying gas heater for heating drying gas supplied through the at least one discharge opening;

at least one outflow line connected to conduct said outflow from the at least one vacuum intake and away from the cleaning head.

70. A cleaning head according to claim 69 wherein the at least one drying gas blower receives drying gas from the at least one drying gas inlet in a manner which does not include significant amounts of recirculated outflow.

71. A cleaning head according to claim 69 wherein the at least one drying gas blower receives drying gas from the at least one drying gas inlet that is open to the ambient air.

72. A cleaning head according to claim 69 wherein the at least one drying gas blower receives drying gas from the at least one drying gas inlet that is open to the ambient air;

and said cleaning head does not include any structure for recirculating said outflow to the at least one drying gas inlet.

73. A cleaning head according to claim 69 wherein the at least one drying gas blower receives drying gas from the at least one drying gas inlet in a manner which does not include said outflow.

74. A cleaning head according to claim 69 wherein the at least one drying gas blower receives drying gas from the at least one drying gas inlet that is open to the ambient air and is constructed in a manner which does not recirculate significant amounts of said outflow.

75. A cleaning head according to claim 69 wherein the at least one drying gas blower receives drying gas from the at least one drying gas inlet that is open to the ambient air and said at least one outflow line discharges said outflow outside of a room in which the cleaning head is working.

76. A cleaning head according to claim 69 wherein the at least one drying gas blower receives drying gas from the at least one drying gas inlet that is open to the ambient air and said at least one outflow line discharges said outflow outside of a building in which the cleaning head is working.

77. A cleaning head according to claim 69 and further comprising at least one cleaning fluid discharge opening for discharging a cleaning fluid within the working area for application to a surface being cleaned.

78. A cleaning head according to claim 69 and further comprising at least one cleaning fluid discharge opening for discharging at least one jet of cleaning fluid within the working area for application to a surface being cleaned.

79. A cleaning head according to claim 69 and further comprising at least one cleaning fluid discharge opening for discharging at least one jet of cleaning fluid within the working area; said at least one jet of cleaning fluid being directed in an orientation that is obliquely angled downward at a surface being cleaned.

80. A cleaning head according to claim 69 and further comprising at least one cleaning fluid discharge opening for discharging at least one jet of cleaning fluid within the working area; said at least one jet of cleaning fluid being directed in an orientation that is obliquely angled downward at a surface being cleaned, and is generally directed toward the at least one intake opening.

81. A cleaning head according to claim 69 and further comprising at least one compressed gas discharge opening for discharging compressed gas within the working area.

82. A cleaning head according to claim 69 and further comprising at least one compressed gas discharge opening for discharging a jet of compressed gas within the working area in an orientation directed angularly downward at a surface being cleaned.

83. A cleaning head according to claim 69 and further comprising at least one compressed gas discharge opening for discharging compressed gas within the working area through nozzles which jet the compressed gas onto a surface being cleaned.

84. A cleaning head according to claim 69 wherein said at least one drying gas blower is mounted upon said cleaning head so as to direct a stream of heated drying gas at a surface being cleaned.

* * * * *

UNITED STATES PATENT AND TRADEMARK OFFICE

CERTIFICATE OF CORRECTION

PATENT NO. : 6,449,799 B1
DATED : September 17, 2002
INVENTOR(S) : Kris D. Keller It is certified that error appears in the above-identified patent and that said Letters Patent is hereby corrected as shown below:

Title page,
Item [56], References Cited, U.S. PATENT DOCUMENTS, add
-- 3,663,984 5/1972 Anthony et al. 15/321 --.

Column 7,
Line 37, after "hot air", delete "pienum" and insert -- plenum --.

Signed and Sealed this

Seventeenth Day of June, 2003

JAMES E. ROGAN
*Director of the United States Patent and Trademark Office*